US006357049B1

(12) United States Patent
Hoffman

(10) Patent No.: US 6,357,049 B1
(45) Date of Patent: Mar. 19, 2002

(54) DECORATIVE COSTUME AND RELATED METHOD

(76) Inventor: Edward J. Hoffman, 20/F, Flat C, Sunrise House, 27 Old Bailey Street, Central (HK)

( * ) Notice: Subject to any disclaimer, the term of this patent is extended or adjusted under 35 U.S.C. 154(b) by 0 days.

(21) Appl. No.: 09/815,629

(22) Filed: Mar. 23, 2001

(51) Int. Cl.[7] ..... A41D 1/00; A42B 1/00

(52) U.S. Cl. ..... 2/69; 2/171; 2/206; 2/DIG. 10; 2/DIG. 3

(58) Field of Search ..... 2/69, 209.13, 75, 2/206, 84, 80, DIG. 10, 173, 171; 46/11

(56) References Cited

U.S. PATENT DOCUMENTS

| | | | | | |
|---|---|---|---|---|---|
| 2,258,531 | A | | 10/1941 | Baldwin | 46/1 |
| 3,329,971 | A | | 7/1967 | Shelby | 2/69 |
| 3,599,240 | A | | 8/1971 | Shapur | 2/75 |
| 4,175,411 | A | * | 11/1979 | Allen et al. | 2/173 |
| 4,218,780 | A | | 8/1980 | Growe et al. | 2/199 |
| 4,498,199 | A | | 2/1985 | Margolis | 2/69 |
| 4,722,098 | A | | 2/1988 | Stapleton | 2/69 |
| 4,800,592 | A | * | 1/1989 | Cable | 2/69 |
| 4,987,615 | A | | 1/1991 | Massey | 2/206 |
| 5,546,604 | A | * | 8/1996 | Geller | 2/202 |
| 5,708,983 | A | | 1/1998 | Cross et al. | 2/171 |
| 5,970,522 | A | | 10/1999 | Apichom | 2/206 |
| 6,041,436 | A | * | 3/2000 | Keen | 2/69 |
| 6,093,475 | A | | 7/2000 | Geller | 428/166 |
| 6,146,721 | A | * | 11/2000 | Freynet | 428/7 |
| 6,163,887 | A | * | 12/2000 | Rogers et al. | 2/173 |

* cited by examiner

*Primary Examiner*—John J. Calvert
*Assistant Examiner*—Alissa L. Hoey
(74) *Attorney, Agent, or Firm*—Harness, Dickey & Pierce, P.L.C.

(57) ABSTRACT

The present invention provides a decorative body costume which covers at least the wearer's entire upper body including the wearer's head and face. The decorative costume includes an inflatable central portion defining a cavity for receiving the head of a person and an upper portion or animated head upwardly extending from the central portion. The inflatable central and upper portions sit atop the wearer's head and in one embodiment add a head and approximately two feet to the wearer's height. The decorative full body costume may be formed to resemble any figure or character. The inflatable central portion may simply sit atop the wearer's head or be additionally secured to the wearer through a fastening device such as straps which attach to the wearer's arms or shoulders. The inflatable central portion may also include appendages in accordance with the theme of the costume, such as arms, fins, or tentacles. In addition to the central portion, upper portions, and appendages, the decorative full body costume includes a decorative drape which in cooperation with the central portion covers at least the wearer's entire upper body including the wearer's head and face. The decorative body drape in combination with the central portion supporting an animated head or upper section and any appendages combine to transform the wearer into an animated character or object.

25 Claims, 5 Drawing Sheets

DECORATIVE COSTUME AND RELATED METHOD

FIELD OF THE INVENTION

The present invention generally relates to a full body costume. More particularly, the present invention relates to a wearable, inflatable costume which fits wearer's head, covers at least the wearer's entire upper body, and transforms the wearer into a desired character having a considerably taller height than the user.

BACKGROUND OF THE INVENTION

Various decorative head and body coverings are provided in the prior art. Such decorative coverings include hats positioned on the wearer's head, headdresses attached to the wearer's head with fastening devices, helmet devices attached to the wearer's head having an inflatable decorative portion on top of the helmet device, and partial decorative body coverings leaving the wearer's head exposed. One particular known arrangement is disclosed in U.S. Pat. No. 4,218,780. The '780 patent teaches a headdress including an inflatable helmet portion. An inflatable caricature portion extends from the helmet portion.

Absent from the prior art is a full body decorative costume which covers at least the wearer's entire upper body, including the wearer's face, and includes an inflatable decorative head covering which sits above the wearer's head.

SUMMARY OF THE INVENTION

It is a principal object of the present invention to provide a full body decorative costume with an upper portion which sits above the wearer's head and a body portion which covers at least the wearer's entire upper body and entire head.

It is another object of the present invention to provide a full body costume which effectively transforms a person into a significantly different and/or taller character.

It is a further object of the present invention to provide a body costume with an inflatable upper portion which is attached to the wearer's head by a fastening arrangement and includes a decorative body portion which covers at least the wearer's entire upper body including the wearer's entire head so as to give the wearer the appearance of a particular character.

In one form, the present invention provides a decorative body costume which covers at least the wearer's entire upper body. The decorative costume includes an inflatable decorative headpiece which sits above the wearer's head so as to add a minimum of approximately two feet to the wearer's height. The decorative headpiece may be formed to resemble any figure, character, or animated object. The decorative headpiece may simply sit above the wearer's head or be fastened to the wearer's body through a fastening device such as straps which attach under the wearer's arms. The costume also includes an upper body section including shoulders. The upper body section may also include appendages in accordance with the theme of the costume, such as arms, fins, or tentacles. The upper body section supports one or more decorative drapes or draped portions to further transform the wearer into a particular character. The decorative draped portions are draped over the upper body section so as to extend the length of the wearer's body and create an inner portion of the costume that receives the wearer. The decorative draped portions in combination with the decorative headpiece and upper body section combine to provide the wearer with the appearance of a new body.

The design of the decorative drape is in accordance with the overall theme of the full body costume. For example, if the decorative headpiece is designed to resemble Frankenstein then the decorative drape will resemble the clothing of Frankenstein. Additionally, if the decorative headpiece is designed to be a Heinz ketchup bottle, then the upper body section and decorative drape will be consistent with the overall design of a Heinz ketchup bottle.

Additional benefits and advantages of the present invention will become apparent to those skilled in the art to which this invention relates from a reading of the subsequent description of the preferred embodiment and the appended claims, taken in conjunction with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
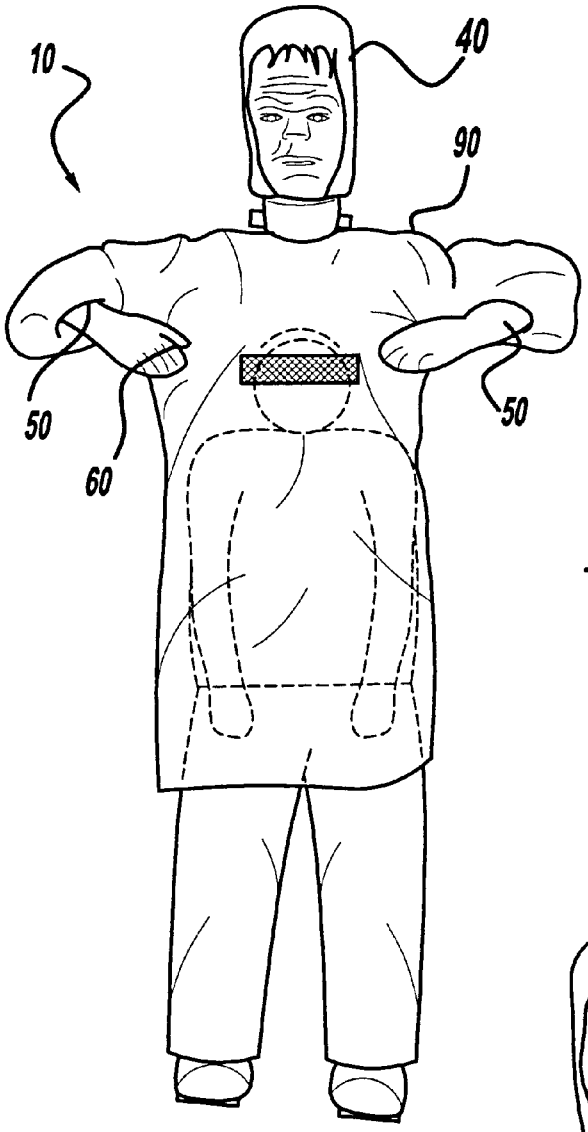
FIG. 1 is an overall view of a wearer wearing a full body costume constructed in accordance with the teachings of a preferred embodiment of the present invention. The full body costume incorporates an inflatable upper portion which sits atop the wearer's head, a central portion which includes the shoulders and the arms of the character, and a decorative drape (Frankenstein clothing) which covers at least the wearer's entire upper body.

With reference to FIG. 1 of the drawings, a full body costume in accordance with the teachings of a preferred embodiment of the present invention is generally identified with reference numeral 10. The full body costume 10 is designed to resemble a particular character. However, it will become apparent to those skilled in the art that the teachings of the present invention have applicability to a wide range of characters.

Figure 2:
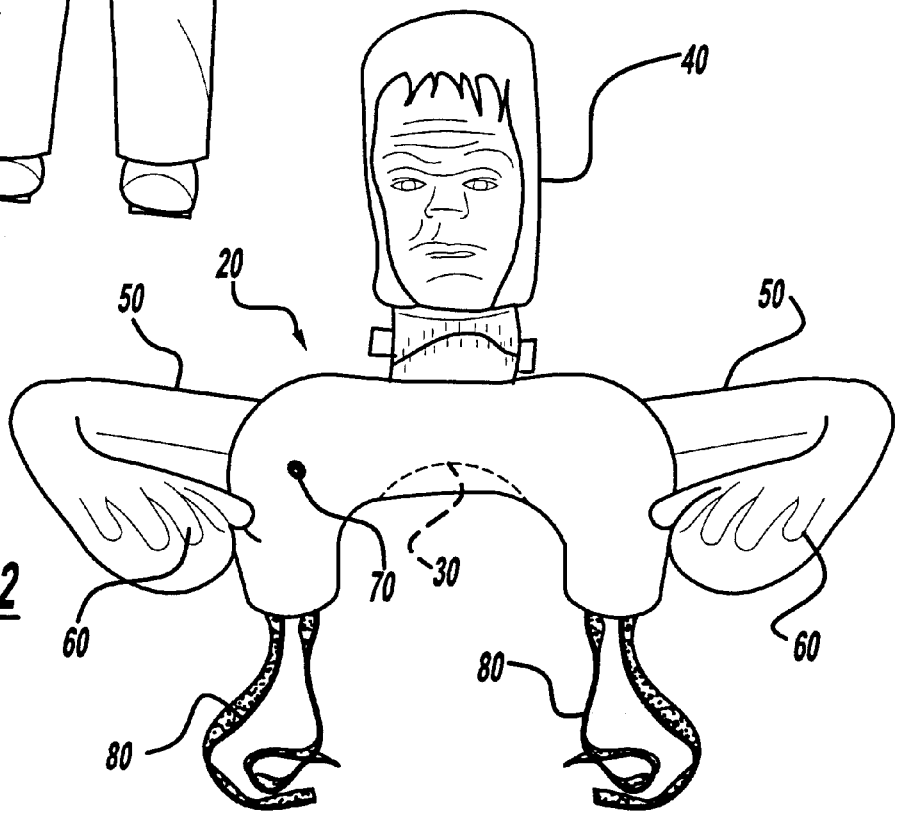
FIG. 2 is an enlarged view of the inflatable central body section of FIG. 1 shown without the decorative body covering and detached from the wearer's head.

With continued reference to FIG. 1 and additional reference to FIG. 2, the full body costume 10 will now be described in greater detail. The full body costume consists of an inflatable upper body or central portion 20 containing a portion defining a cavity 30 for receiving the wearer's head (shown in phantom lines). From the central portion 20 extends an animated head 40. The animated head 40 is made of an inflatable material and is preferably in fluid communication with the central portion 20. The animated head 40 is of a design consistent with the overall theme of the full body costume 10.

The central portion or section 20 is shown in the preferred embodiment to include shoulders, an upper body and a neck of the particular characters animated appendages 50 extend laterally in opposite directions and are inflatable. The animated appendages 50 are shaped and formed in accordance with the overall theme of the full body costume 10 and may resemble numerous different types appendages such as arms, fins, or tentacles. In the embodiment illustrated, the appendages 50 are arms. The appendages 50 may contain movable digits 60 capable of carrying light objects. The central portion 20, the animated head 40, and the laterally extending appendages 50 are preferably in fluid communication with one another and inflatable through one or more inflation valves 70.

Upon the head of the wearer, the central portion 20 supporting the animated head 40 adds to the perceived height of the character. In one application, the character appears to be approximately two feet taller than the wearer. The central portion 20 may either sit freely above the head of the wearer or may be attached to the wearer's body by two pairs of straps 80 extending from the central portion 20 and under the arms of the wearer. Significantly, the air cavity defined by the central portion 20 has a substantial dimension in both lateral directions from the head opening 30. Such a configuration allows the upper head cavity to conform to the wearer's head thereby facilitating secure attachment for various sized wearers.

The central portion 20 is further shown to extend slightly downwardly as it laterally extends from the head opening 30. These lateral portions engage the wearer's head and provide additional stability for the costume. The lateral portions may extend further downward and sit upon the shoulders for additional stability.

Both pairs of straps 80 downwardly extend from the central portion 20 where straps of a common pair may be secured to one another proximate to the wearer's under arms. The straps 80 may be fastened in any conventional manner such as by snaps, hook and loop material, and the like. The straps 80 may also slip under the arms with an elastic fit.

To cover at least the wearer's entire upper body and face, the full body costume 10 preferably contains a decorative drape 90. The drape 90 is supported by and draped over the central portion 20. The drape 90 downwardly extends from the central portion 20 to cover at least the wearer's face and entire upper body. The drape 90 is designed in accordance with the overall theme of the full body costume 10. The drape 90 includes a mesh portion 92 through which the wearer can see and breath without being visible and thereby detracting from the costume.

Figure 3:
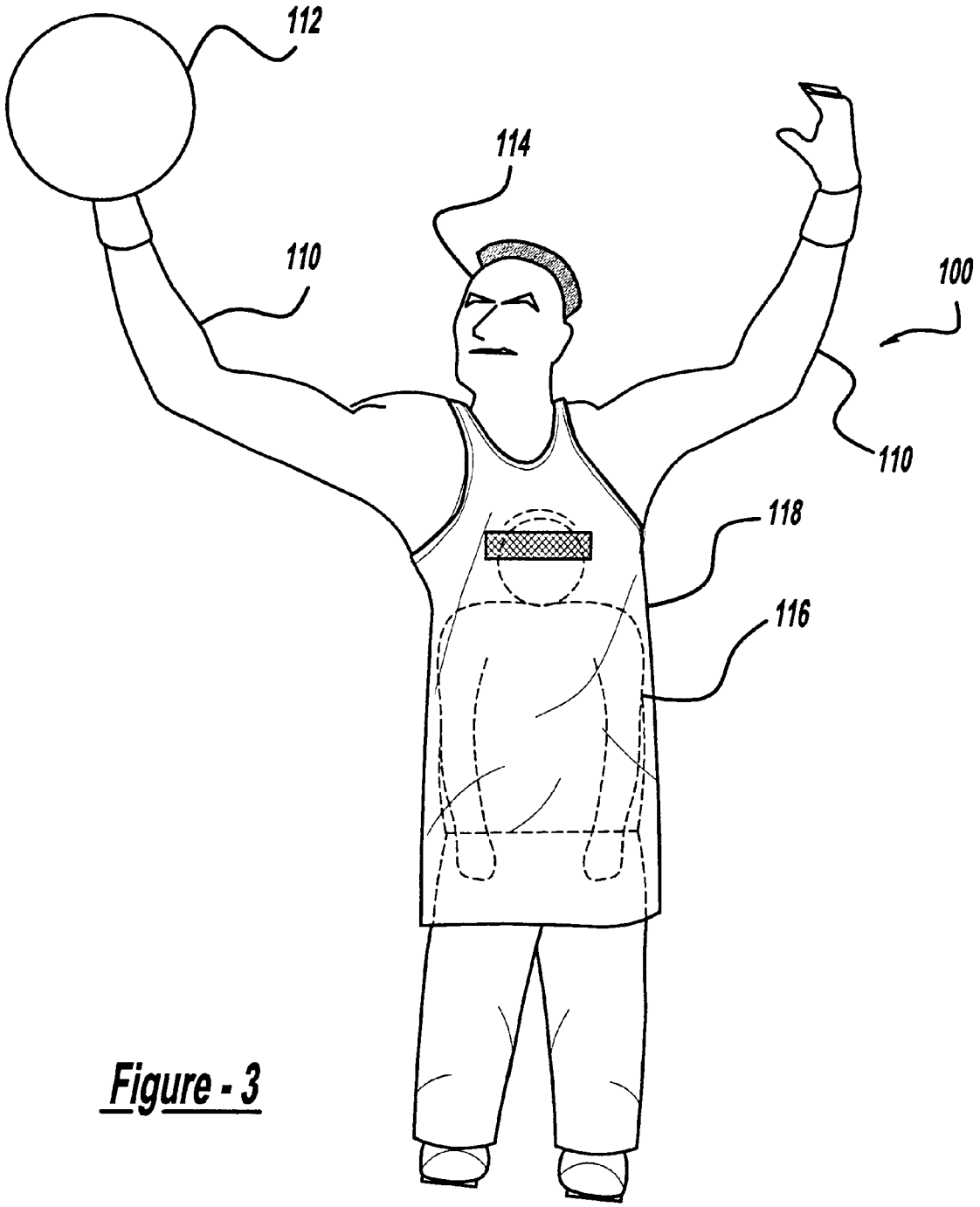
FIG. 3 is a first alternative embodiment of the full body costume of the present invention.

Turning to FIG. 3, a full body costume in accordance with the teachings of a first alternative embodiment is illustrated and generally identified at reference number 100. As shown, the full body costume 100 transforms the wearer into a basketball player. While not specifically shown, it will be understood that the fully body costume 100 includes a central portion similar to the central portion 20 discussed above with respect to the full body costume 10. One of the arms 110 carries a basketball 112. The appendages 110 and basketball 112 are preferably inflatable and may or may not be in fluid communication with the central portion. An inflatable head 114 upwardly extends from the central portion. A drape 116 having the appearance of a basketball jersey is supported by and draped over the central portion. The drape 116 includes a mesh portion 118 through which the wearer can see and breath.

Figure 4A:
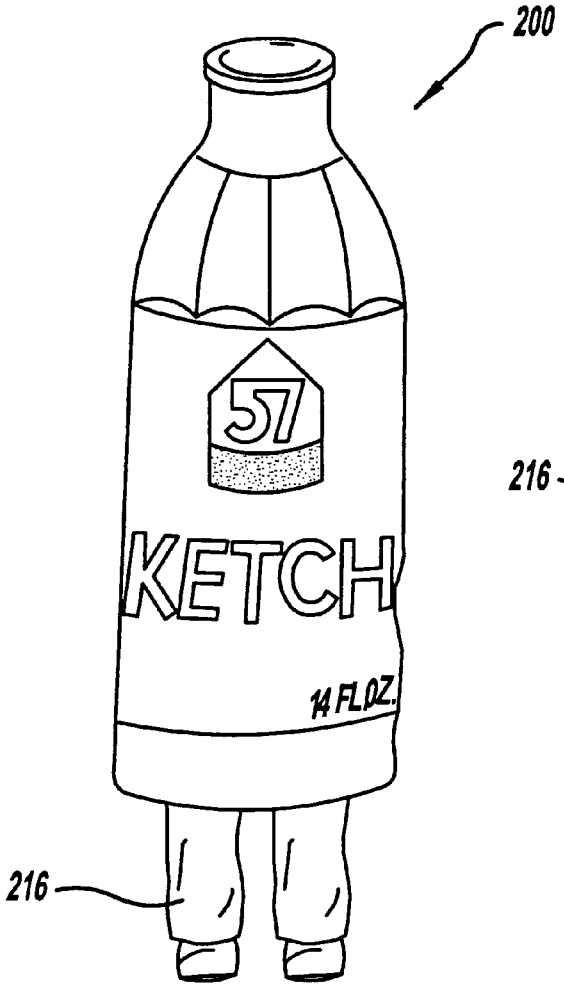
FIG. 4A is a front view of a second alternative embodiment of the full body costume of the present invention shown with a wearer positioned inside.
Figure 4B:
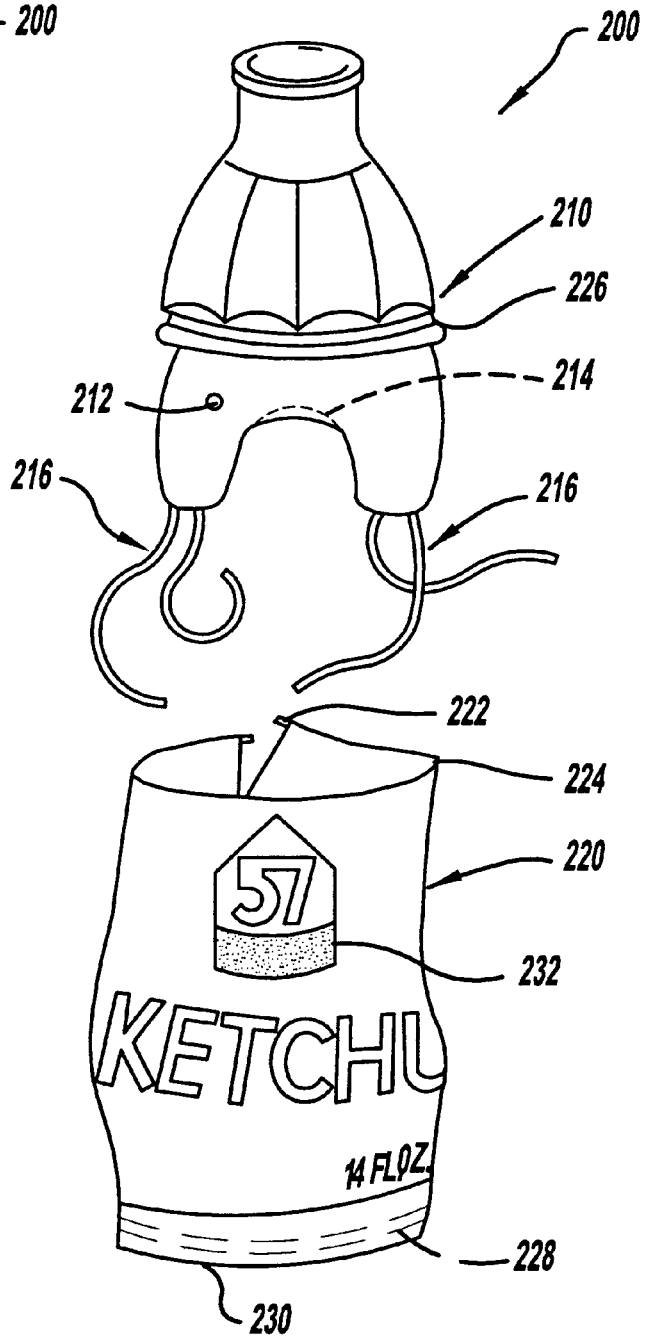
FIG. 4B is an exploded view of the full body costume of the second alternative embodiment of the present invention.

With reference to FIGS. 4A and 4B, a fully body costume in accordance with the teachings of a second alternative embodiment is illustrated and generally identified at reference number 200. As shown, the fully body costume 200 of the second alternative embodiment of the present invention transforms the wearer into a ketchup bottle. The full body costume 200 includes a main body portion 210 which is preferably inflatable and has the exterior appearance of the upper portion of a ketchup bottle. As with the preferred embodiment of the present invention, the main body portion 210 is inflatable through one or more inflation valves 212 and partially defines a cavity 214 for receiving the head of a user or wearer 216. Two pairs of straps 216 downwardly extend from the main body portion 210 for securement below the arms of the wearer 216.

In the embodiment illustrated, a lower draped portion 220 is constructed out of a flexible material and includes a drawstring 222 or other fastening arrangement for securement to the main body portion 210. Tightening and tying of the drawstring 222 retains an upper edge 224 of the lower draped portion 210 within a reduced diameter groove 226 defined by the main body portion 210. The cylindrical shape of the lower draped portion 210 is maintained by a substantially rigid hoop 228 secured adjacent a lower edge 230 of the lower draped portion 220. The hoop 228 may be disposed within a hem of the lower draped portion 220 or otherwise suitably secured to the lower draped portion 220. The lower draped portion 220 includes a mesh section 232 through which the wearer 216 can see and breathe.

Figure 5A:
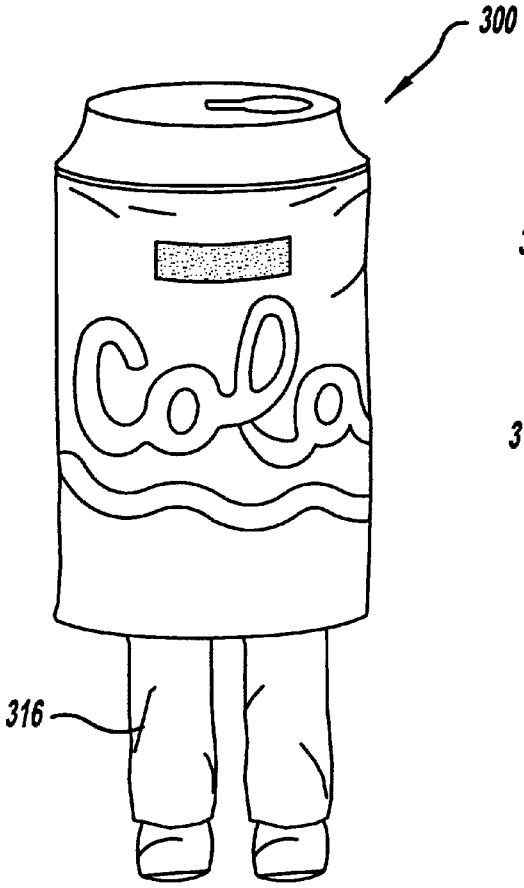
FIG. 5A is a front view of a third alternative embodiment of the full body costume of the present invention shown with a wearer positioned inside.
Figure 5B:
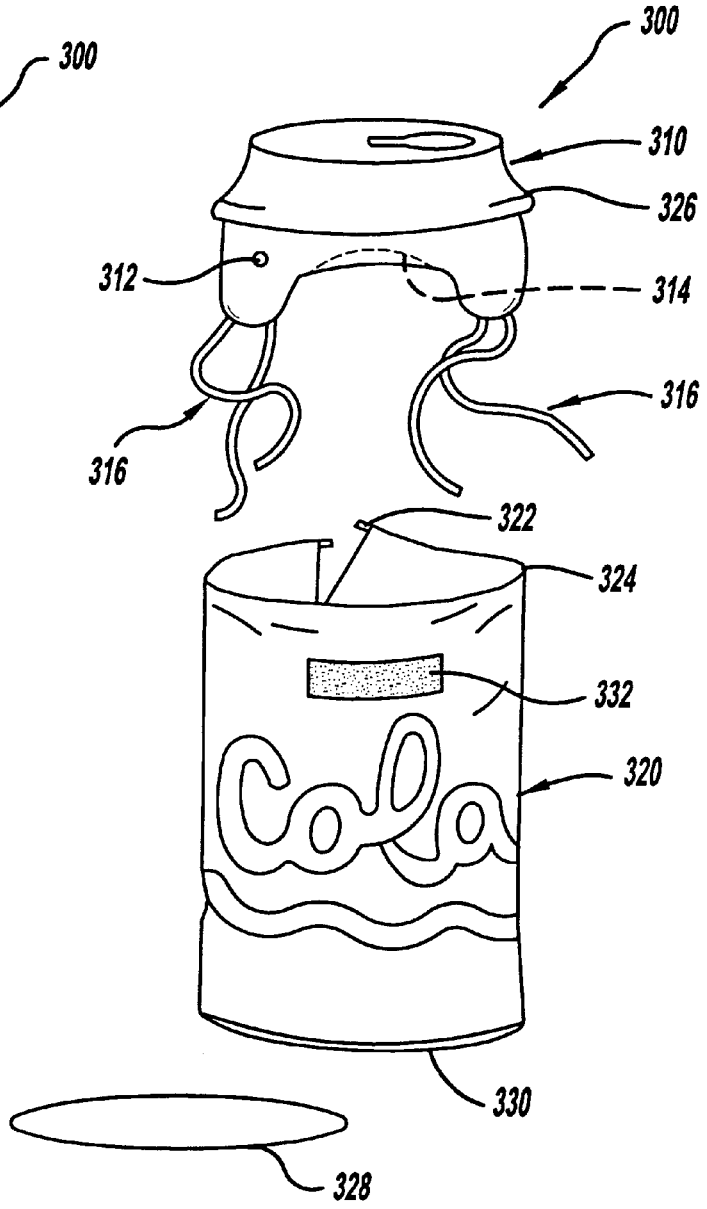
FIG. 5B is an exploded view of the full body costume of the third alternative embodiment of the present invention.

With reference to FIGS. 5A and 5B, a fully body costume in accordance with the teachings of a third alternative embodiment is illustrated and generally identified at reference number 300. As shown, the fully body costume 300 of the third alternative embodiment of the present invention transforms the wearer into a soda can. The full body costume 300 includes a main body portion 310 which is preferably inflatable and has the exterior appearance of the upper portion of a soda can. As with the preferred embodiment of the present invention, the main body portion 310 is inflatable through one or more inflation valves 312 and partially defines a cavity 314 for receiving the head of a user or wearer 316. Two pairs of straps 316 downwardly extend from the main body portion 310 for securement below the arms of the wearer 316.

In the embodiment illustrated, a lower draped portion 320 is constructed out of a flexible material and includes a drawstring 322 or other fastening arrangement for securement to the main body portion 310. Tightening and tying of the drawstring 322 retains an upper edge 324 of the lower draped portion above a radially extending flange 326 defined by the main body portion 310. The cylindrical shape of the lower draped portion 310 is maintained by a substantially rigid hoop 328 secured adjacent a lower edge 330 of the lower draped portion 320. The hoop 328 may be disposed within a hem of the lower draped portion 320 or otherwise suitably secured to the lower draped portion 320. The lower draped portion 320 includes a mesh section 332 through which the wearer 216 can see and breathe.

Figure 6A:
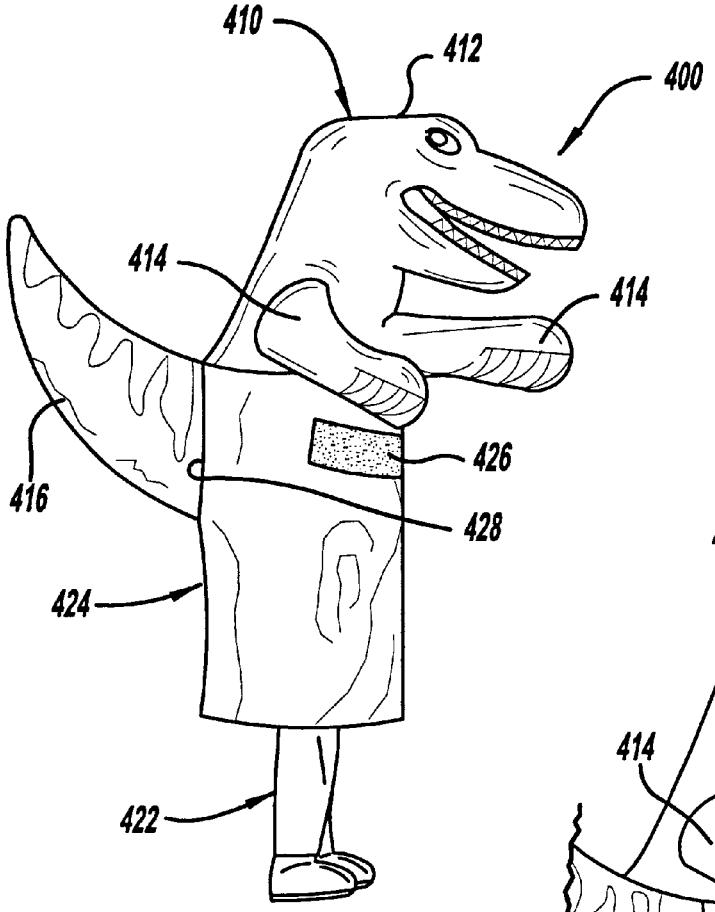
FIG. 6A is a side view of a fourth alternative embodiment of the full body costume of the present invention shown with a wearer positioned inside.
Figure 6B:
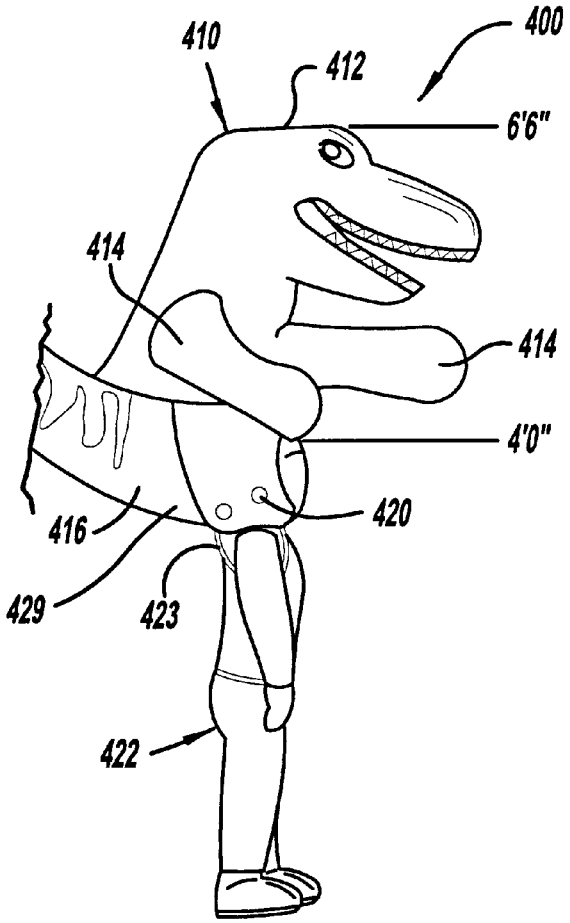
FIG. 6B is a side view similar to FIG. 6A shown with a lower drape portion removed for purposes of illustration.

Turning finally to FIGS. 6A and 6B, a full body costume in accordance with a fourth alternative embodiment of the present invention is illustrated and generally identified at reference numeral 400. As shown, the full body costume 400 of the fourth alternative embodiment of the present invention transforms the wearer into a dinosaur. The full body costume 400 includes a main body portion 410 which is preferably inflatable and has the exterior appearance of a head 412, arms 414 and tail 416 of a dinosaur. Again, the main body portion 410 is inflatable through one or more inflation valves 420 and defines a cavity (not specifically shown) for receiving the head of a wearer 422. In the particular embodiment illustrated, the full body costume 400 transforms a wearer 422 having a height of approximately 4 feet into a dinosaur having a height of approximately 6 feet, 6 inches. As shown, the main body portion 410 engages the shoulders of the wearer 422 and straps 423 are tightly fastened under the arms of the wearer 422. The straps 423 function to pull the main body portion 410 down tightly and securely. As with the prior embodiments, the cavity defined for the head of the wearer fits tightly over the head. The tight "hat" fit, together with the shoulder supports, holds the inflated portions of the full body costume 400 securely to the wearer.

As with the embodiments discussed above, the full body costume 400 includes a lower draped portion 424 for covering at least the upper body of the wearer 422. As with the prior embodiments, the lower draped portion 424 includes a mesh portion 426 through which the wearer 422 can see and breathe. An opening 428 of the lower drape portion 424 accommodates the tail 416. The lower draped portion 424 is secured in the preferred embodiment to the main body portion 410 with a hook and loop type fastener. The lower drape portion 424 is preferably printed with the body of a dinosaur. Further in the preferred embodiment, the lower draped portion 424 is constructed of a breathable PVC material in the same color and finish as the main body portion 410.

Figure 7:
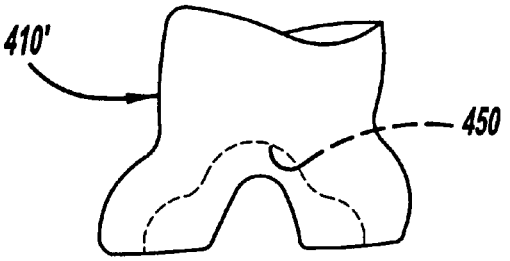
FIG. 7 illustrates a variation of the main body portion 410 of the body costume 400 of FIGS. 6A and 6B.

With reference to FIG. 7, a variation to the main body portion 410 of the full body costume 400 of FIGS. 6A and 6B is illustrated and generally identified at reference numeral 410'. In this variation, the main body portion defines a cavity 450 (shown in phantom) which not only receives the head of the wearer 422 but also receives upper portions of the shoulders of the wearer. Such an arrangement may be desirable for certain applications to provide additional stability. The portions of the cavity 450 which receive the shoulders do so with a tight "hat" fit. In this regard, the main body portion inflates and the pressure of inflation causes a compressive force on the head and shoulders to further stabilize the full body costume 400.

It will now be apparent to those skilled in the art that the present invention provides an inflatable costume which is lightweight, stable and securely mountable to a wearer. The teachings of the present invention effectively transform a person into a significantly different and possibly taller character while preferably hiding the identity of the wearer.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. For example, the embodiments described herein are directed to a single wearer. Alternatively, a costume can be made for more than one person (e.g., a cow or dragon costume could be made with a person in the head and the tail of the character). Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A decorative costume for dressing a person as an animated character when the person is positioned within the costume, the decorative costume comprising:

an inflatable central portion defining a cavity for receiving a head of the person having a laterally extending dimension significantly greater than a lateral dimension of the cavity;

an upper portion extending from the central portion; and one or more appendages laterally extending significantly beyond the inflatable central portion.

2. The decorative full body costume of claim 1, wherein the upper portion is inflatable.

3. The decorative costume of claim 2, wherein the central portion and the upper portion are in fluid communication.

4. The decorative costume of claim 1, wherein the one or more laterally extending appendages are configured in the form of animated appendages for the animated character.

5. The decorative costume of claim 4, wherein the one or more laterally extending appendages are inflatable.

6. The decorative costume of claim 5, wherein the central portion and the one or more laterally extending appendages are in fluid communication with one another and inflatable through at least one inflation valve.

7. The decorative costume of claim 5, wherein the animated head is inflatable and the central portion, the animated head, and the one or more laterally extending appendages are in fluid communication with one another and inflatable through at least one inflation valve.

8. The decorative costume of claim 1, wherein the costume is attached to the person by a pair of straps extending from the central portion, the pair of straps being laterally spaced from the cavity.

9. The decorative costume of claim 1, wherein the central portion defines animated shoulders, supports and animated neck and provides support for an animated head and a lower portion of the costume.

10. The decorative costume of claim 1, wherein the upper portion is an animated head.

11. The decorative costume of claim 1, further comprising a lower draped portion supported by and covering at least a portion of the inflatable central portion and downwardly extending from the inflatable central portion.

12. The decorative costume of claim 11, wherein the lower draped portion is draped over the central portion for covering at least a face of the person, the lower draped portion including a section of a mesh material for the person to see and breathe through.

13. The decorative costume of claim 1, wherein the cavity defined by the inflatable central portion is generally circular in a horizontal plane such that the inflatable central portion will continuously engage the person's head in a circumferential direction.

14. The decorative costume of claim 1, wherein the cavity is concavely shaped and tapers in an upwardly extending direction to securely receive the head of the person.

15. The decorative costume of claim 1, wherein the central portion defines a body of the animated character.

16. A method of dressing a person as an animated character, the method comprising the steps of:

providing a costume having an inflatable central portion, a pair of laterally extending portions and an animated head, the pair of laterally extending portions extending significantly beyond the central portion; and receiving a head of the person at least partially within the central portion.

17. The method of claim 16, further comprising the step of inflating the animated head.

18. The method of claim 16, wherein the central portion and the animated head are in fluid communication with one another and inflatable through at least one inflation valve.

19. The method of claim 18, wherein the laterally extending portions are in the form of animated arms.

20. The method of claim 16, further comprising the step of extending the pair of laterally extending portions extending in opposite directions from the central portion, the laterally extending portions configured in the form of animated appendages for the animated character.

21. The method of claim 20, wherein the central portion and the laterally extending portions are in fluid communication with one another and inflatable through at least one inflation valve.

22. The method of claim 20, wherein the animated head is inflatable and the central portion, the animated head, and the pair of laterally extending portions are in fluid communication with one another and inflatable through at least one inflation valve.

23. The method of claim 16, wherein the pair of laterally extending portions are inflatable.

24. The method of claim 16, wherein the step of attaching the costume to the person comprises the steps of providing a pair of straps downwardly extending from the central portion and securing the pair of straps under the arms of the person.

25. The method of claim 16, further comprising the step of providing a drape supported by and draped over the central portion and downwardly extending from the central portion, the drape covering at least a face of the person.

* * * * *